US007563115B2

(12) United States Patent
van gen Hassend et al.

(10) Patent No.: US 7,563,115 B2
(45) Date of Patent: Jul. 21, 2009

(54) PLUG-IN POWER SUPPLY WITH EXCHANGEABLE MAINS PLUG UNIT

(75) Inventors: Kay van gen Hassend, Hasbergen (DE); Ulrich Bernsmann, Warendorf (DE); Manfred Wegmann, Ostbevern (DE); Michael Bothe, Munster (DE); Yonggui Wu, Youngfeng (CN)

(73) Assignee: Friwo Geraetebau GmbH, Ostbevern (DE)

( * ) Notice: Subject to any disclaimer, the term of this patent is extended or adjusted under 35 U.S.C. 154(b) by 26 days.

(21) Appl. No.: 11/511,191

(22) Filed: Aug. 28, 2006

(65) Prior Publication Data

US 2007/0047182 A1 Mar. 1, 2007

(30) Foreign Application Priority Data

Aug. 30, 2005 (DE) ..... 10 2005 041 116

(51) Int. Cl.
*H01R 29/00* (2006.01)

(52) U.S. Cl. ..... 439/171; 439/218

(58) Field of Classification Search ..... 439/170–175, 439/217, 218, 221
See application file for complete search history.

(56) References Cited

U.S. PATENT DOCUMENTS

| | | | | |
|---|---|---|---|---|
| 5,934,921 | A | 8/1999 | Doong | |
| 6,320,353 | B1 | 11/2001 | Chiu et al. | |
| D454,537 | S | 3/2002 | O'Connor et al. | |
| 7,008,246 | B2 * | 3/2006 | Zhuge | 439/173 |
| 2005/0176281 | A1 | 8/2005 | Zhuge | |

FOREIGN PATENT DOCUMENTS

| | | |
|---|---|---|
| CN | 2694564 | 4/2005 |
| DE | 43 22 087 | 1/1995 |
| JP | 2000164306 | 6/2000 |
| TW | 421 366 | 2/2001 |
| WO | WO 2004/013937 | 2/2004 |

OTHER PUBLICATIONS

Office Action from CN patent office for application No. 200680000747.0 dated Oct. 10, 2008 (English translation attached).

* cited by examiner

*Primary Examiner*—Felix O Figueroa
(74) *Attorney, Agent, or Firm*—Michael Best & Friedrich LLP

(57) ABSTRACT

A plug-in power supply wherein the mains plug unit is exchangeable in the form of a conversion plug system. The plug-in power supply includes a housing having a voltage transformer module for converting a mains voltage into the required low voltage, and an exchangeable mains plug unit with at least two mains plug pins. The plug-in power supply includes an exchangeable mains plug unit, and the housing includes at least two spring contacts which are electrically connected to the voltage transformer module. The mains plug unit includes at least two contact pins which cooperate with the spring contacts so as to establish an electric contact with the mains plug pins, and each contact pin is arranged in a separate recess.

10 Claims, 13 Drawing Sheets

PLUG-IN POWER SUPPLY WITH EXCHANGEABLE MAINS PLUG UNIT

RELATED APPLICATIONS

The present patent application claims the foreign priority of German Patent Application No. 10 2005 041 116.9, filed on Aug. 30, 2005.

BACKGROUND OF THE INVENTION

1. Field of the Invention

The present invention relates to a plug-in power supply for supplying a consumer with a low voltage, and in particular to a plug-in power supply wherein the mains plug unit is exchangeable in the form of a conversion plug system.

2. Description of the Related Art

Plug-in power supply units in the lowest power range are nowadays increasingly built as switching mode power supply units. Due to their small dimensions and their low weight, they have established themselves in many fields of application and they replace the traditional linear devices. By means of the switching mode power supply technology, a so-called universal input voltage input can easily be realized so that the power supply unit can, as far as its electronic concept is concerned, theoretically be operated at each power socket in the world. This, however, is prevented by the great differences existing worldwide between the plug systems and plug shapes, this has the consequence that unsafe so-called plug adapters have to be additionally used in most cases; due to the enlarged distance between the plug-in power supply and the power socket, these plug adapters may increase the torque, which acts on the power socket, in an inadmissible manner.

Hence, the implementation of an exchangeable conversion plug, which is integrated in the design of the device, is a much safer and therefore desirable alternative.

German patent DE 43 22 086 C2 discloses a plug-in power supply for supplying electric devices with low voltage, wherein contacting between the device and the conversion plugs takes place via spring contacts, the respective spring contacts being accommodated in the plug and being in contact with the voltage transformer module of the power supply unit via contact surfaces on the circuit board of the power supply unit. This solution is, however, comparatively complex, since two springs are required per plug version and since the mains plug units must additionally be implemented such that they each consist of two plastic components, viz. the plug contour and a cover, so as to guarantee the touch protection demanded. These parts must be interconnected by means of a precise supersonic welding process, and, in the case of non-optimum welding, the insertion and separation forces between the plug and the plug-in power supply will increase to unacceptable values. Furthermore, the plug unit is not safely locked. It follows that the solution according to this publication is complex, expensive and it offers only a limited process reliability.

U.S. Pat. No. 6,320,353 B1 discloses the implementation of a plug system according to IEC 320 for establishing a contact between a plug-in power supply and an exchangeable mains plug unit. This solution, however, requires for each plug the implementation of a complete socket with two spring contacts per plug and it partly requires stamped and bent components for establishing the connection between the spring contacts and the plug pins. Furthermore, the plug housing is here again bipartite so that the necessary touch protection can be guaranteed. Hence, also this construction is comparatively complex and expensive.

Reference U.S. D454,537 S discloses a solution wherein the electric contact between the device and the plug is established by means of two spring contacts, which are arranged in the housing. The number of springs required is reduced in this way. The plug is oriented parallel to the longitudinal side of the device. The spring contacts are here exposed and may twist in the case of inappropriate treatment. Due to the fact that the plug is pushed on in longitudinally arranged guide means, two slots having a width of approx. 4 mm and a length of approx. 20 mm are formed in the plug. The dimensions of these slots exceed the admissible values of the maximum opening width, according to which the maximum dimensions must not exceed 1.8 mm×4.8 mm. It follows that the structural design shown in this document violates the relevant regulations on electric shock protection.

Furthermore, a locking engagement is established via a plastic spring, which is integrated in the device in question, in the arrangement shown in this publication, said plastic spring including, however, openings to the circuit board, i.e. it only has a limited ESD resistance. Moreover, the plug components for the UK plug each consist of two plastic parts, and this makes the structural design again comparatively complex and expensive.

The Taiwanese publication TW421366Y discloses an arrangement with comparatively broad spring contacts in the housing, said spring contacts being arranged transversely to the longitudinal side. The plug is here connected to the housing in that it is first introduced in a slotted guide means and then pushed on along the housing. Contacting is effected through long longitudinal slots in the plug (approx. 2.5×30 mm) directly onto the plug pins. The dimensions of these slots exceed the admissible values of the air and creepage distances. It follows that also in the case of this structural design, the relevant regulations on electric shock protection are violated. A locking engagement is guaranteed by a separate locking bar with an additional spring. Also in this case, the implementation of the plug housing is bipartite for all plug embodiments, i.e. also this structural design is comparatively complex and therefore expensive.

The published international patent application WO 2004/013937 A1 discloses a plug coupling wherein an exchangeable mains plug is arranged on the housing of a plug-in power supply, the housing having provided thereon a protruding guide web with contact elements and the mains plug being provided with a complementary cavity for accommodating the guide web. The guide web is provided with a recess and the mains plug has arranged thereon a complementary pin for locking engagement with said recess, so that, by means of a suitable movement of the mains plug relative to the housing, the mains plug can be fixed to the housing and a connection can be established between the contact elements of the mains plug and the contact elements of the guide web.

However, the plug coupling according to this reference is disadvantageous insofar as it does, on the one hand, not comply with the relevant standards with regard to air and creepage distances and insofar as, on the other hand, unlocking of said plug coupling is comparatively difficult to realize.

SUMMARY OF THE INVENTION

It is an object of the present invention to provide an improved plug-in power supply with an exchangeable mains plug unit, which complies with the relevant safety standards all over the world, which can be produced inexpensively and easily, and which is also easy to operate.

The present invention is based on the idea of providing an inexpensive, standard conversion plug system for a plug-in power supply, wherein the power supply unit has provided thereon spring-type protruding contacts so that the respective primary-side conversion plug can be attached, said contacts cooperating with mating contacts accommodated in recesses formed in the conversion plug. Each contact pin of the mains plug unit is arranged in a separate recess, the dimensions of which are implemented such that the provisions of the international standard IEC 60884 with regard to touch protection and tracking resistance are fulfilled.

In this way, a plug-in power supply can easily be provided, which can be produced at a reasonable price and which is easy to handle and offers nevertheless improved touch protection and an improved ESD resistance. The handling of the device in its entirety is substantially simplified as far as an exchange of plugs is concerned, and the overall design can be implemented such that a better process reliability will be achieved.

The recesses can e.g. have a rectangular cross-section with dimensions of less than 1.8 mm×4.8 mm. This complies with the relevant regulations on electric shock protection with regard to the admissible values for air and creepage distances.

When the contact pins are arranged such that they are adapted to be brought into contact with the end faces of the spring contacts in a direction extending essentially along an insertion direction of the mains plug pins in the mains socket, a torque, which could possibly impair the quality of the electric contact, will be prevented from acting on the connection between the conversion plug and the plug-in power supply upon insertion into the mains plug.

According to an advantageous further development of the present invention, the spring contacts are, at least partially, encompassed by a collar. Such a collar protects the spring contacts against damage during an exchange of the mains plug unit. It will be advantageous when such a collar has a U-shaped cross-section, since this will guarantee maximum mechanical safety on the basis of the lowest possible material costs.

According to a particularly simple embodiment, such a collar can be formed integrally with the housing, in particular it can be formed on the housing in the course of an injection moulding process executed for producing the housing from plastic material.

When the mains plug pins are formed integrally with the associated contact pins, this will guarantee maximum stability and the lowest possible contact resistance on the one hand and an easy manufacturing on the other.

The mains plug pins and the contact pins can, in a particularly simple manner, be combined so as to form the mains plug unit by encompassing them by an insulating plastic material by means of injection moulding. This kind of arrangement allows the mains plug unit to be produced as one part, i.e. the production costs will be reduced still further.

According to an advantageous further development of the present invention, the mains plug unit is adapted to be lockingly engaged with the housing. A reliable connection between the two parts can be achieved in this way, but, if necessary, said parts can easily be separated.

Especially by providing on the housing a pocket-like detent spring, which cooperates with a complementary locking opening on the mains plug unit so as to fix said mains plug unit, the releasability of the of the mains plug unit can be realized in a particularly simple and economy-priced manner and it can simultaneously be guaranteed that the device can be handled easily and safely by a user. The detent spring, which is formed integrally with the housing by injection moulding, has the additional advantage that it will improve the ESD resistance.

When the housing has formed thereon a slotted guide means for guiding the mains plug unit during the mounting operation, mounting by the user can be made much more simple. Simultaneously, a maximum position reliability of the contact pins relative to the contact springs will be guaranteed. A structurally very simple solution is here the provision of a slotted guide means that extends in a direction transversely to a direction in which the mains plug pins are inserted into the mains socket.

BRIEF DESCRIPTION OF THE DRAWINGS

The accompanying drawings are incorporated into and form a part of the specification for the purpose of explaining the principles of the invention. The drawings are not to be construed as limiting the invention to only the illustrated and described examples of how the invention can be made and used. Similar or corresponding details of the plug-in power supply according to the present invention are provided with identical reference numerals. Further features and advantages will become apparent from the following and more particular description of the invention is illustrated in the accompanying drawings, wherein.

DETAILED DESCRIPTION OF THE INVENTION

Figure 1:
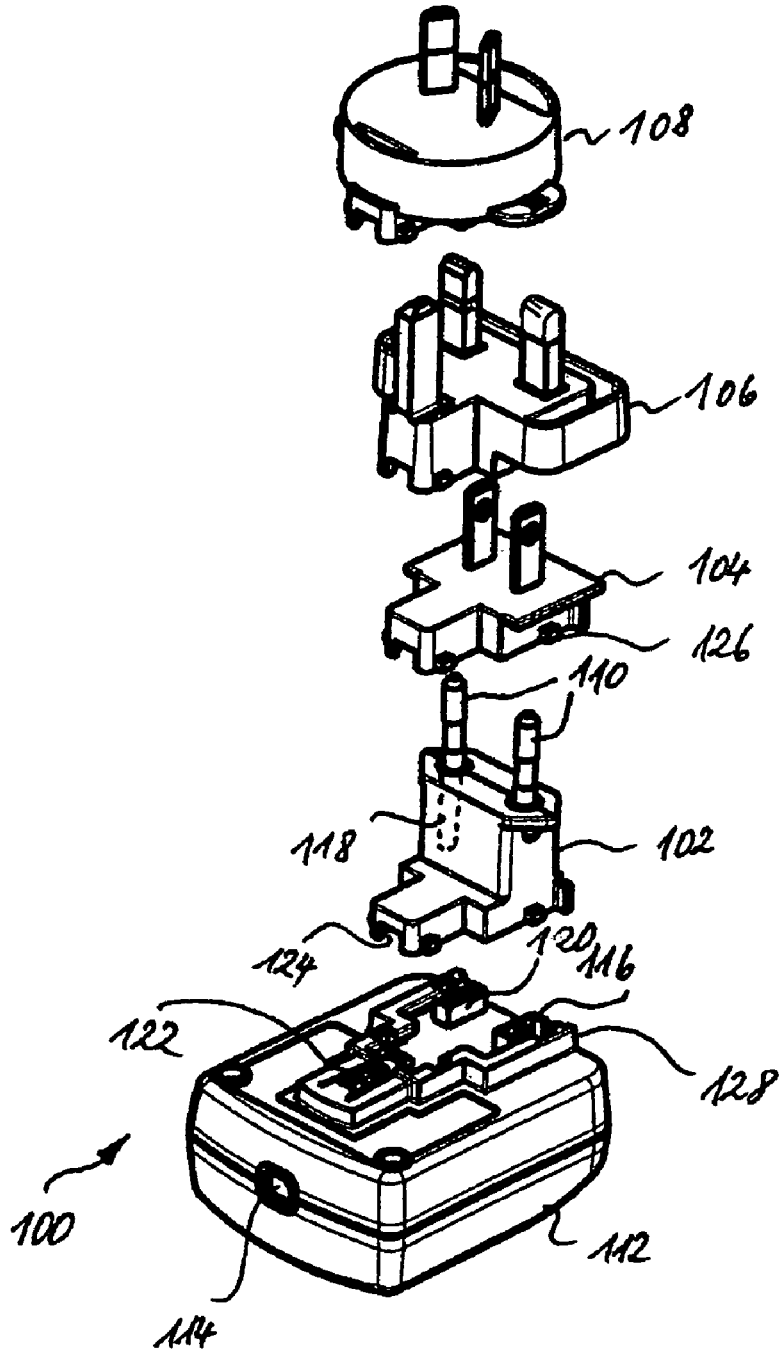
FIG. 1 shows a perspective view of a plug-in power supply according to the present invention in accordance with a first advantageous embodiment.

The illustrated embodiments of the present invention will be described with reference to the figure drawings wherein like elements and structures are indicated by like reference numbers.

Referring now to the Figures and in particular to FIG. 1, the plug-in power supply 100 according to the present invention, which comprises exchangeable mains plug units 102, 104, 106 and 108, will now be explained in detail. The exchangeable mains plug units 102 to 108 comply, with regard to their plug contour and the implementation of the mains plug pins 110, with the standards of various countries, such as the European standard EN 50075 for the mains plug unit 102, the US standard for the mains plug unit 104, the British standard for the mains plug unit 106 as well as the Australian standard for the mains plug unit 108. This selection is, however, only exemplary, and the person skilled in the art will be aware of the fact that the principles according to the present invention can be applied to arbitrary other plug contours and pin shapes.

As can be seen from FIG. 1, the plug-in power supply according to the present invention comprises a housing 112 having arranged therein a voltage transformer module, which is here not shown, for converting a mains voltage into a required low voltage. The opening 114 serves to pass therethrough a low voltage cable which is here not shown and which leads to a consumer. The housing 112 may, however, also be a component of a consumer.

According to the present invention, the housing 112 has provided thereon spring contacts 116, which are connected in the interior of the housing to input terminals of the voltage transformer module. The mains plug pins 110 are formed integrally with respective contact pins 118 in the mains plug unit 102 to 108, said contact pins 118 establishing with the spring contacts 116 an electric connection to the mains socket (which is here not shown).

The contact pins 118 are accommodated in small, 1.8 mm×4.8 mm, rectangular recesses so as to observe the relevant regulations on electric shock protection.

The plug contour for all types of plugs can advantageously be implemented in a single process step by encompassing the plug pins 110 by injection moulding. Subsequent expensive process steps are therefore rendered unnecessary.

In the embodiment shown in FIG. 1, the spring contacts 116 are prevented from being twisted, during mounting of the exchangeable mains plug unit 102 to 108, by means of projections of plastic material 120, which are formed integrally with the housing by injection moulding and which are implemented in the form of a U-shaped collar, said projections of plastic material 120 and the wall of the housing 112 encompassing these springs.

The fact that the exchangeable mains plug unit 102 to 108 may be fabricated as one piece additionally implies that no supersonic welds are necessary and that, consequently, a particularly high stability can be achieved.

The arrangement according to the present invention is additionally characterized by a locking arm 122, which is formed integrally with the housing 112 by injection moulding and which, for locking the exchangeable mains plug unit 102 to 108, cooperates with a complementary locking opening 124 provided in said exchangeable mains plug unit. Guiding projections 126 cooperate with a slotted guide groove 128 formed on the housing 112 and used for guiding the mains plug unit 102 to 108 when the said mains plug unit is being mounted on the housing 112.

Figure 2:
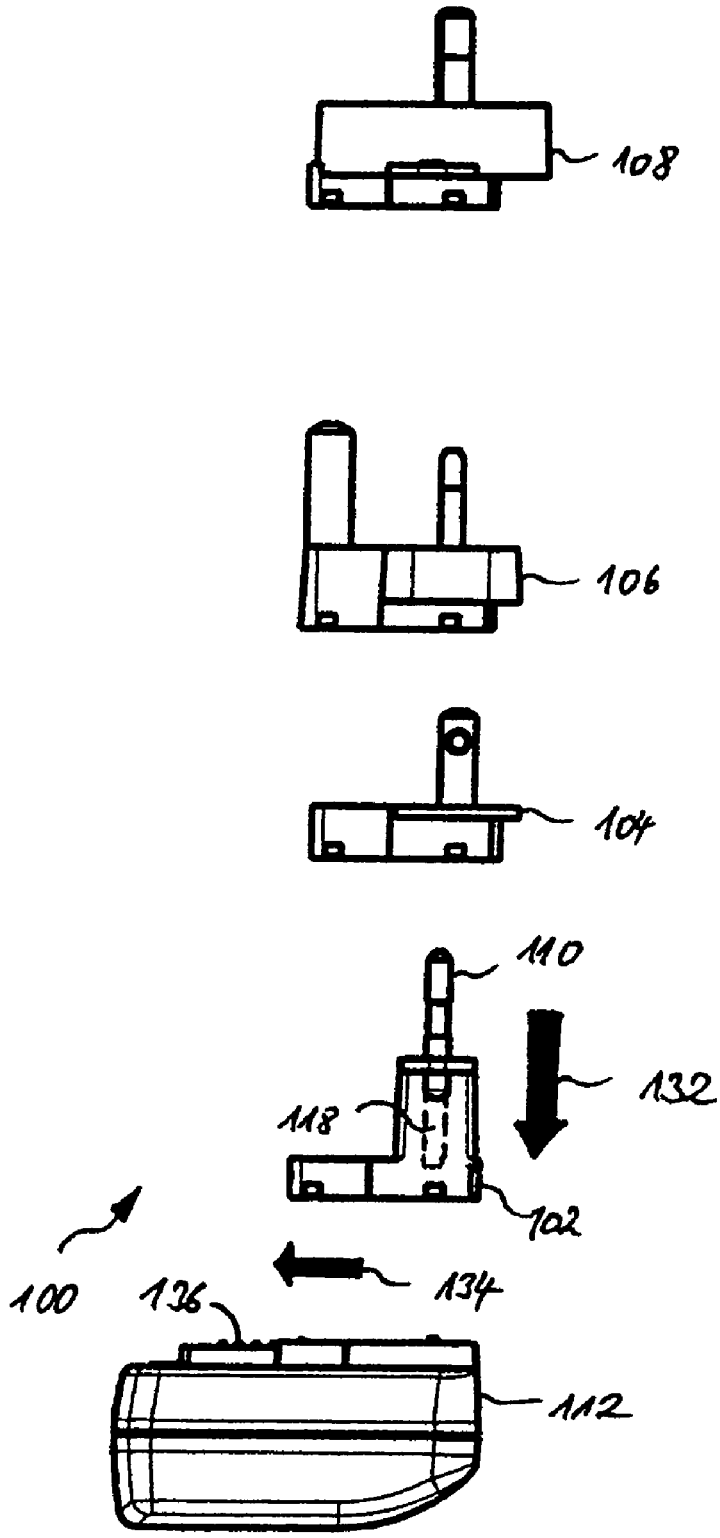
FIG. 2 shows a side view of the arrangement according to FIG. 1.
Figure 3:
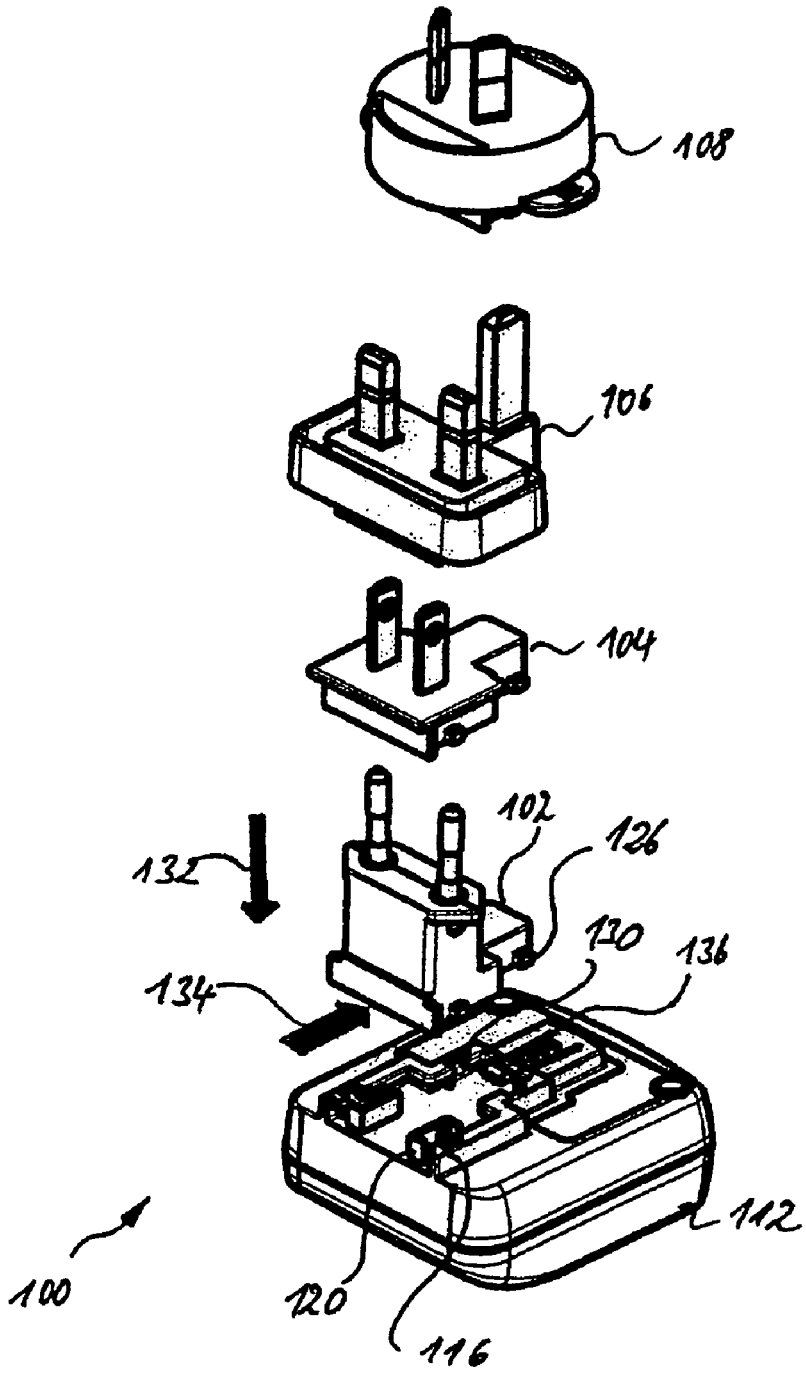
FIG. 3 shows a rotated perspective view of the arrangement according to FIG. 1.

Additional views of the plug-in power supply 100 according to the present invention are shown in FIGS. 2 and 3.

Referring to a synopsis of FIGS. 1 to 3, the mounting of the exchangeable mains plug unit 102 will be explained in detail in the following.

Assuming first that no mains plug unit 102 to 108 is mounted on the housing 112, a mains plug unit according to the standard of the desired country, e.g. for Europe the mains plug unit 102, is chosen and oriented such that the mains plug pins 110 are directed away from the housing 112 and that the projections 126 are essentially located above the associated insertion openings 130.

Subsequently, the mains plug unit is moved in direction 132 until the guiding projections 126 are able to cooperate with the slotted guide groove 128. The direction 132 extends essentially parallel to the direction of insertion in the mains socket.

In the next mounting step, the mains plug unit 102 is moved in a direction 134 transversely to the direction of insertion in the mains socket until the locking arm 122 engages the locking opening 124. In the course of this process, the mains plug unit 102 is guided in the slotted guide groove 128. The plug-in power supply 100 is now ready for operation.

For removing the mains plug unit 102, it will suffice to press the operating surface 136 on the locking arm 122 so as to release the locking connection so that the mains plug unit can be pushed in a direction opposite to said direction 134 and can then be removed in a direction opposite to the direction 132.

A further embodiment of the plug-in power supply according to the present invention will be explained in detail making reference to FIG. 4 to 24.

Figure 4:
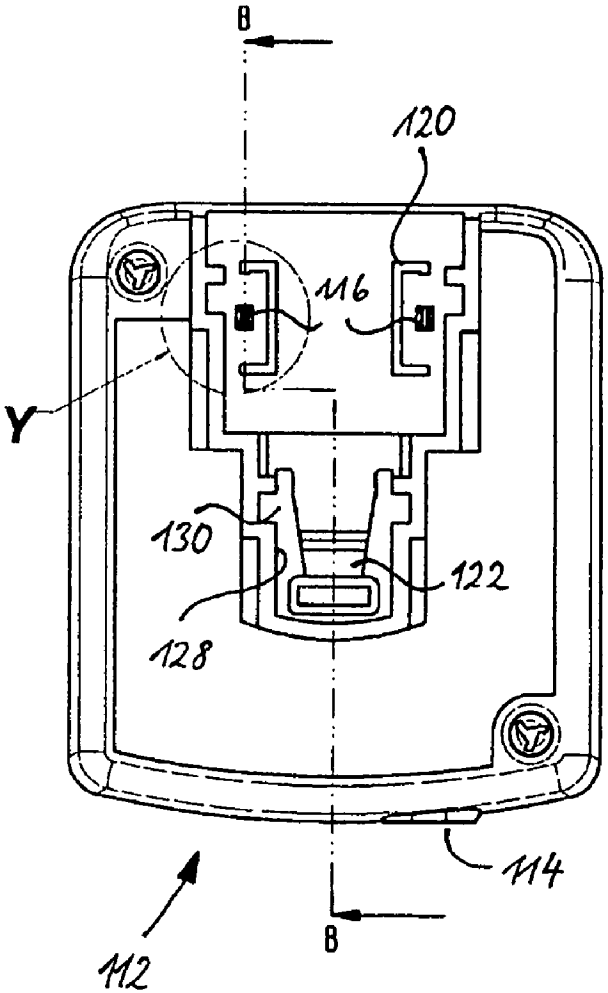
FIG. 4 shows a top view of a housing according to a further advantageous embodiment.
Figure 5:
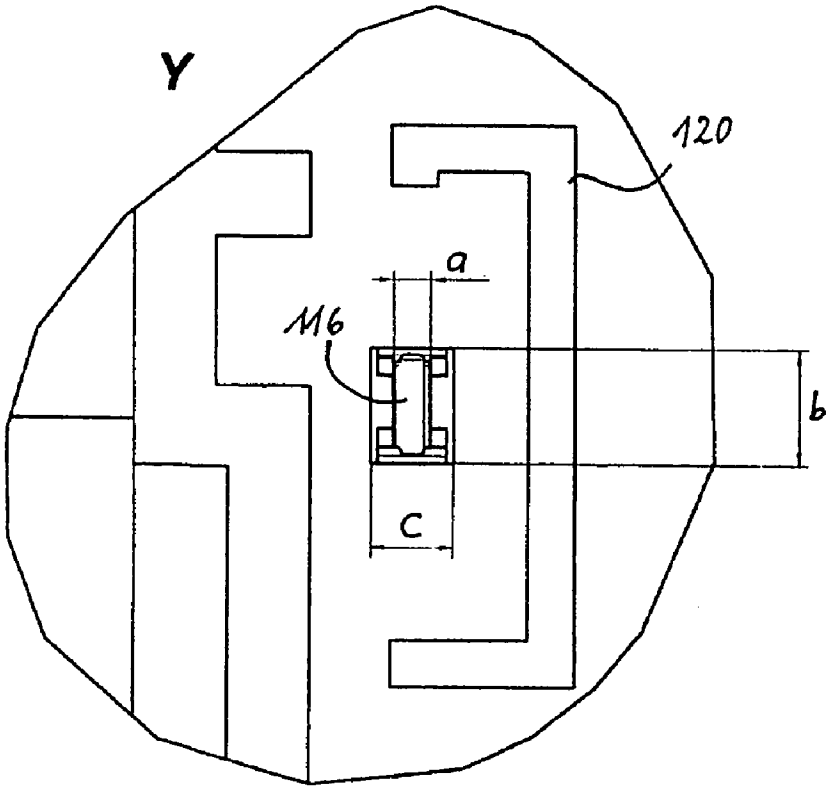
FIG. 5 shows a detail Y of FIG. 4.
Figure 6:
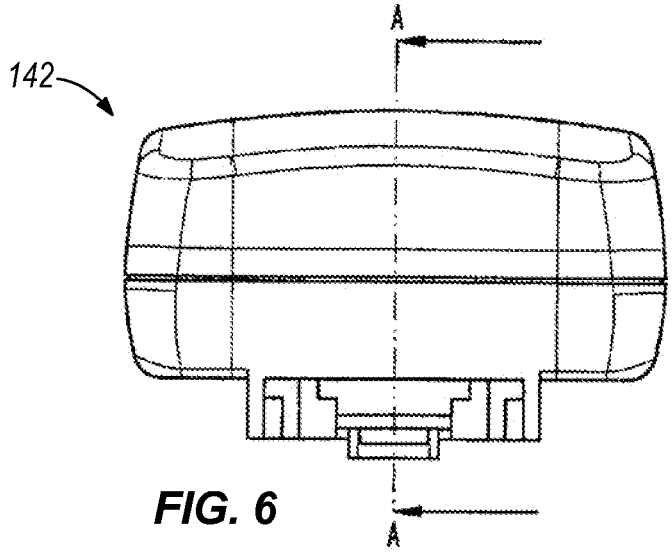
FIG. 6 shows a side view of the housing according to FIG. 4, rotated by 90°.

Other than in the case of the hitherto described embodiments, the openings in the plug modules, through which a contact between the spring contact and the mains pin is established, have been reduced to a width of 0.9 mm. This has been done for observing the British standard, without using an additional shutter. The accessibility of the contacts can be tested by a test finger having a diameter of 1 mm. Accordingly, the width of the contact springs was adapted to approx. 0.8 mm FIG. 4 shows the side of the housing 112 on which the mains plug unit 102 to 108 is mounted. In the inserted condition of the mains plug unit 102 to 108, the spring contacts 116 are in contact with the mains plug pins 110. As can be seen from the detail Y shown in FIG. 5, the spring contacts 116 have particularly small dimensions so as to be able to electrically contact the contacts which are, in the associated mains plug units, accommodated in recesses that are very small according to the present invention.

The spring contacts 116 may e.g. have a width of only 0.8 mm and a length b of 2.5 mm. A mounting opening for inserting the spring contacts 116 in the housing 112 has e.g. a dimension c of 1.8 mm. For allowing the spring contact to be inserted in the associated standard recesses of the mains plug unit, the height h of the spring contact, which can be seen in FIG. 8, should be approx. 6.2 mm.

In order to prevent such fine structures from being damaged during operation, the present invention is so conceived that the spring contacts 116 are protected by a substantially U-shaped collar 120. Twisting of the spring contacts 116 during replacement of the mains plug unit is to be prevented to a very large extent by means of this collar 120 in combination with the guiding elements that have already been described with regard to the preceding embodiment.

Figure 7:
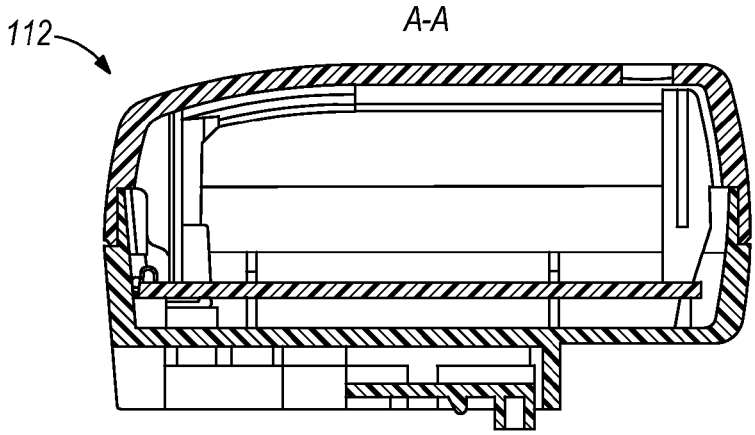
FIG. 7 shows a section through the housing of FIG. 6 along the intersection line A-A.
Figure 8:
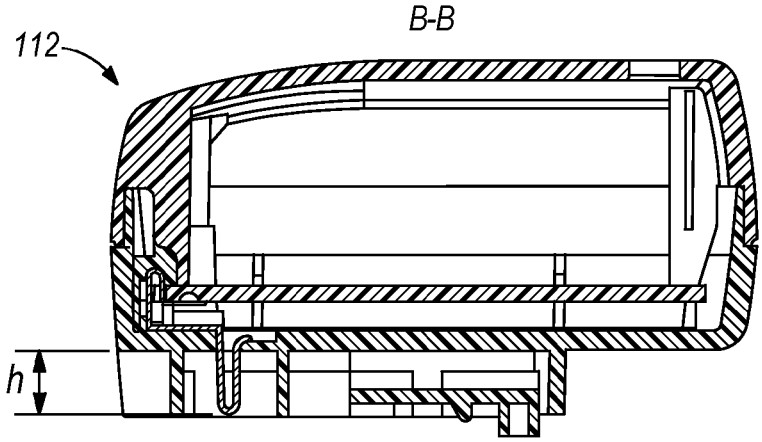
FIG. 8 shows a section through the housing of FIG. 4 along the intersection line B-B.
Figure 9:
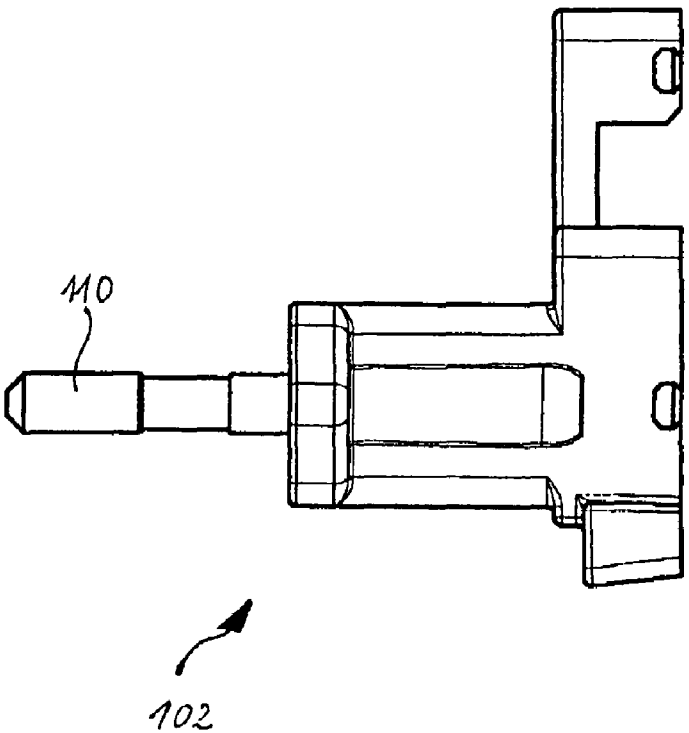
FIG. 9 shows a side view of a first mains plug unit, which is adapted to be inserted into the housing according to FIGS. 4 to 8.
Figure 10:
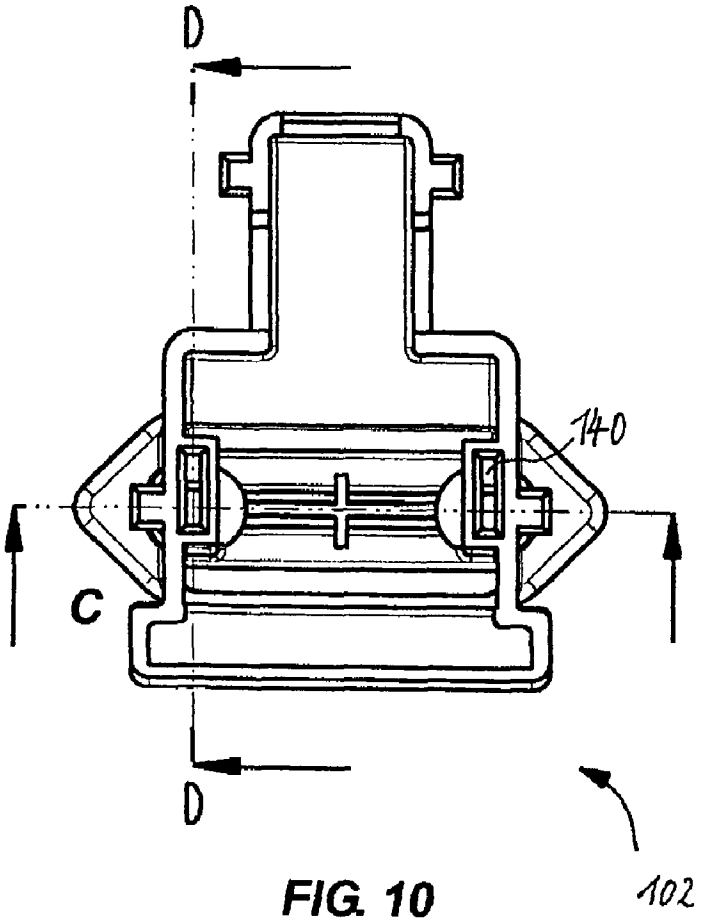
FIG. 10 shows a view of the mains plug unit according to FIG. 9, rotated by 90°.
Figure 11:
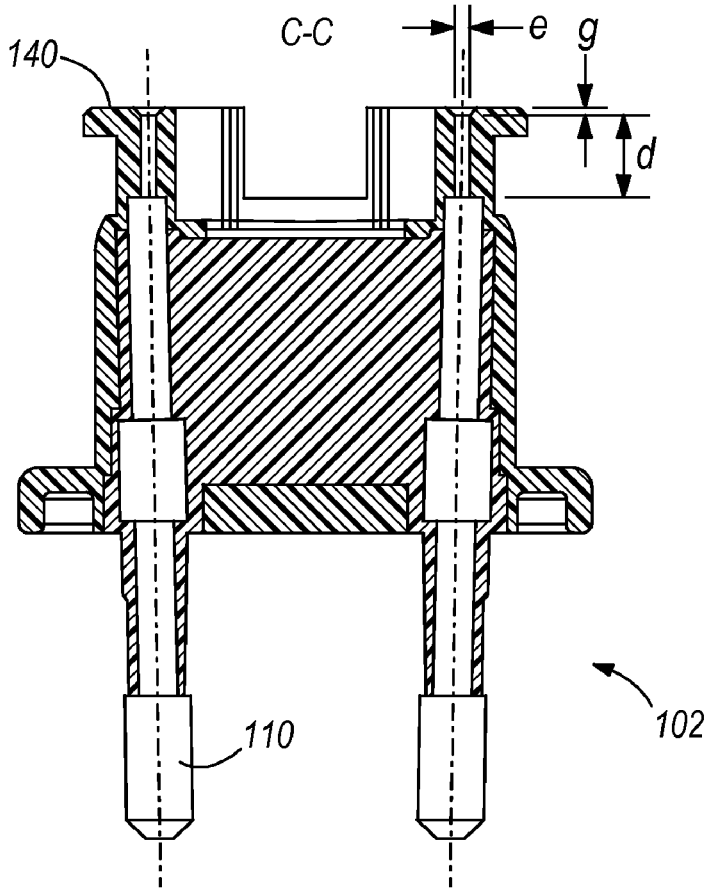
FIG. 11 shows a section through the arrangement according to FIG. 10 along the intersection line C-C.
Figure 12:
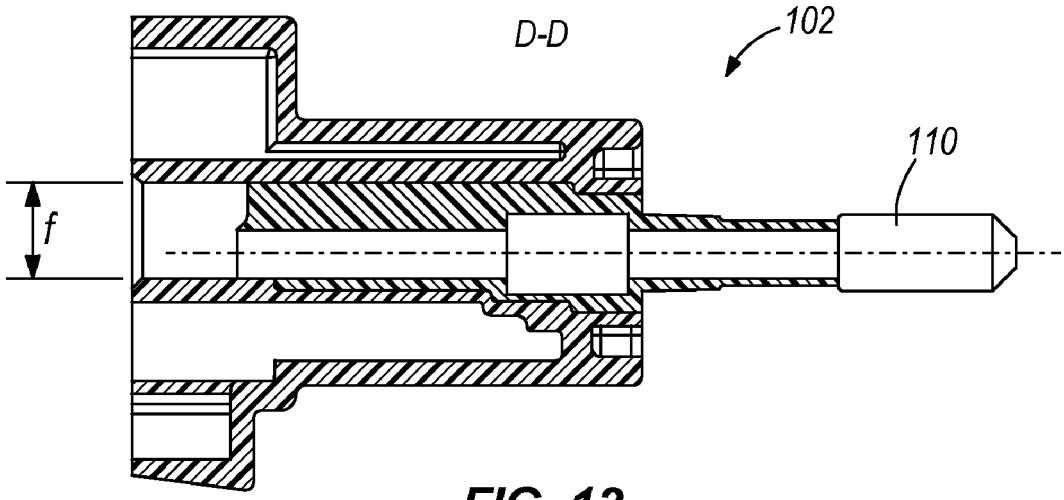
FIG. 12 shows a section through the arrangement according to FIG. 10 along the intersection line D-D.
Figure 14:
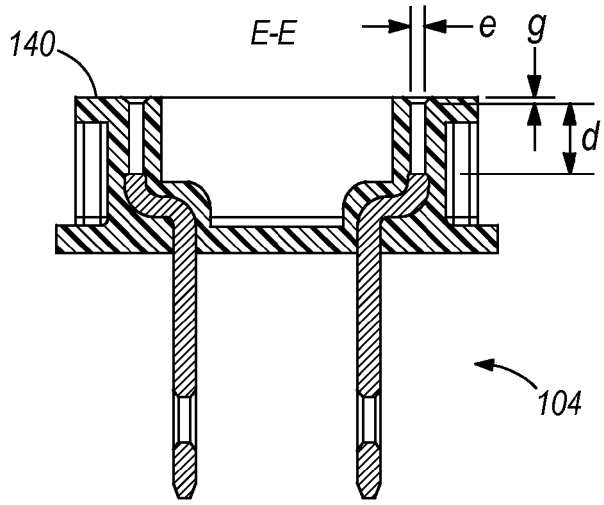
FIG. 14 shows a section through the mains plug unit according to FIG. 13 along the intersection line E-E.
Figure 13:
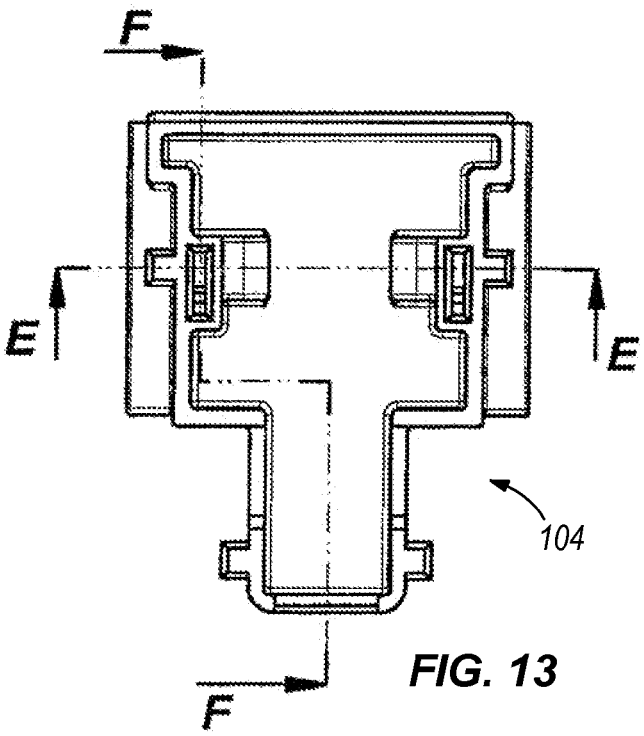
FIG. 13 shows a top view of a mains plug unit according to a further advantageous embodiment.
Figure 15:
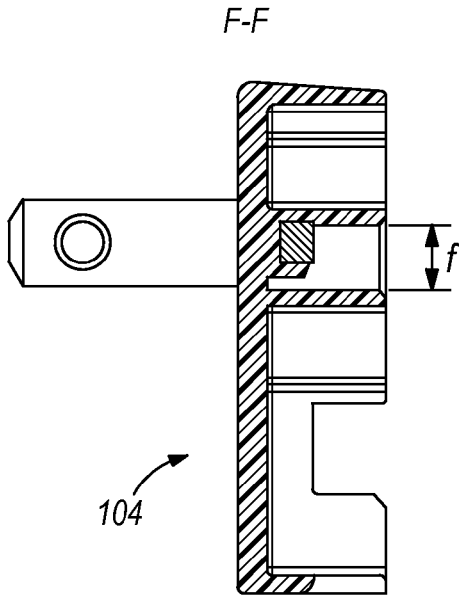
FIG. 15 shows a section through the mains plug unit according to FIG. 13 along the intersection line F-F.
Figure 16:
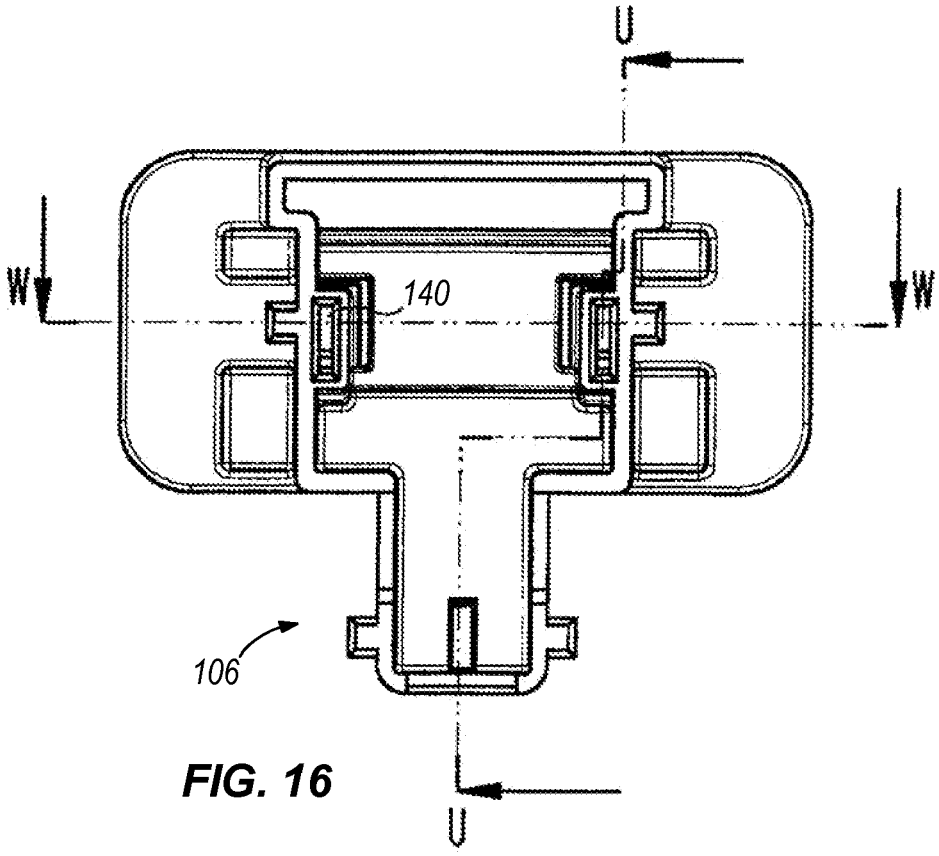
FIG. 16 shows a top view of a mains plug unit according to another advantageous embodiment.
Figure 18:
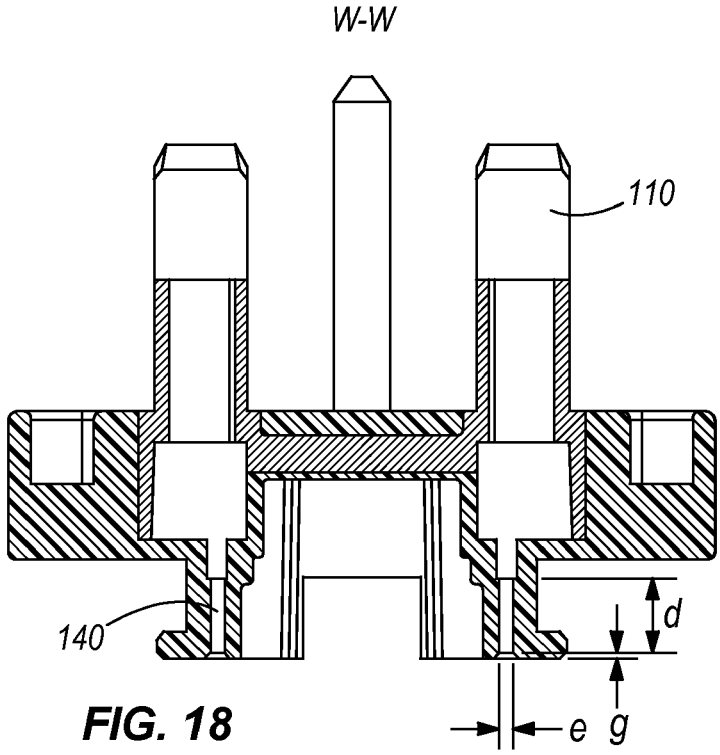
FIG. 18 shows a section through the mains plug unit according to FIG. 16 along the intersection line W-W.
Figure 17:
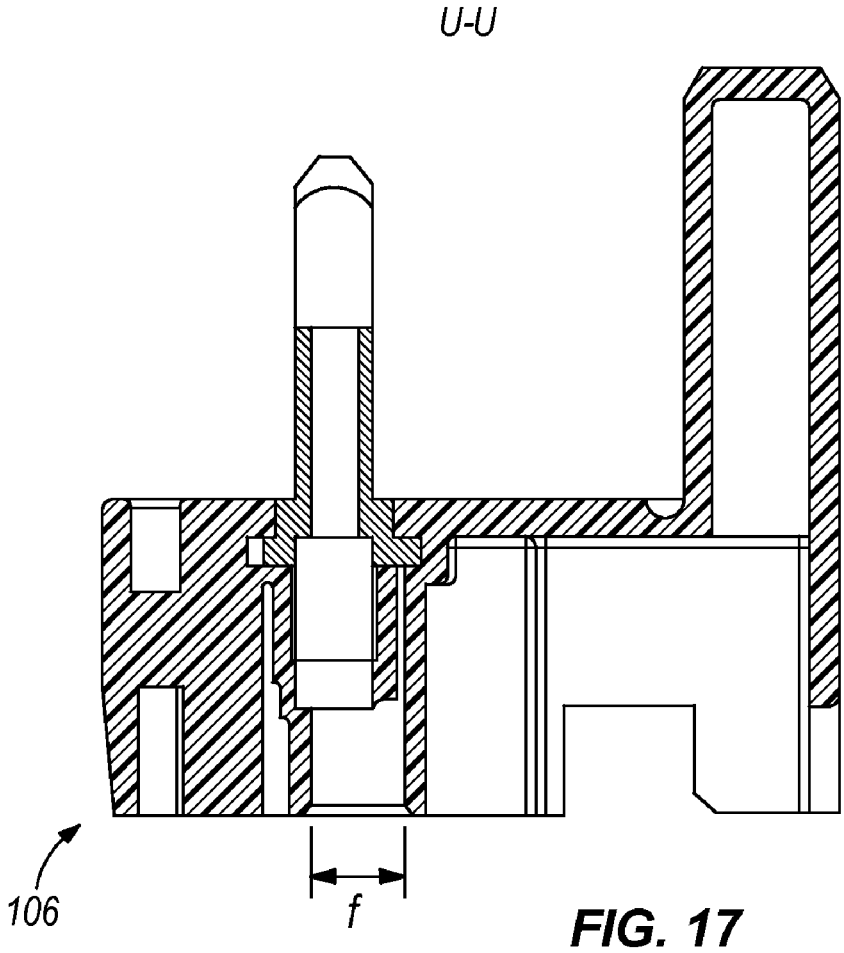
FIG. 17 shows a section through the mains plug unit according to FIG. 16 along the intersection line U-U.
Figure 20:
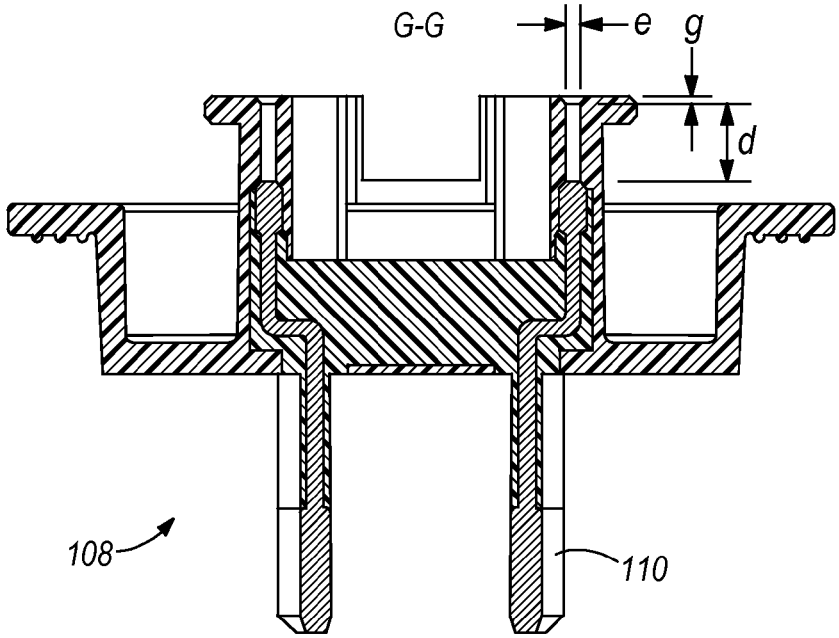
FIG. 20 shows a section through the mains plug unit according to FIG. 19 along the intersection line G-G.
Figure 19:
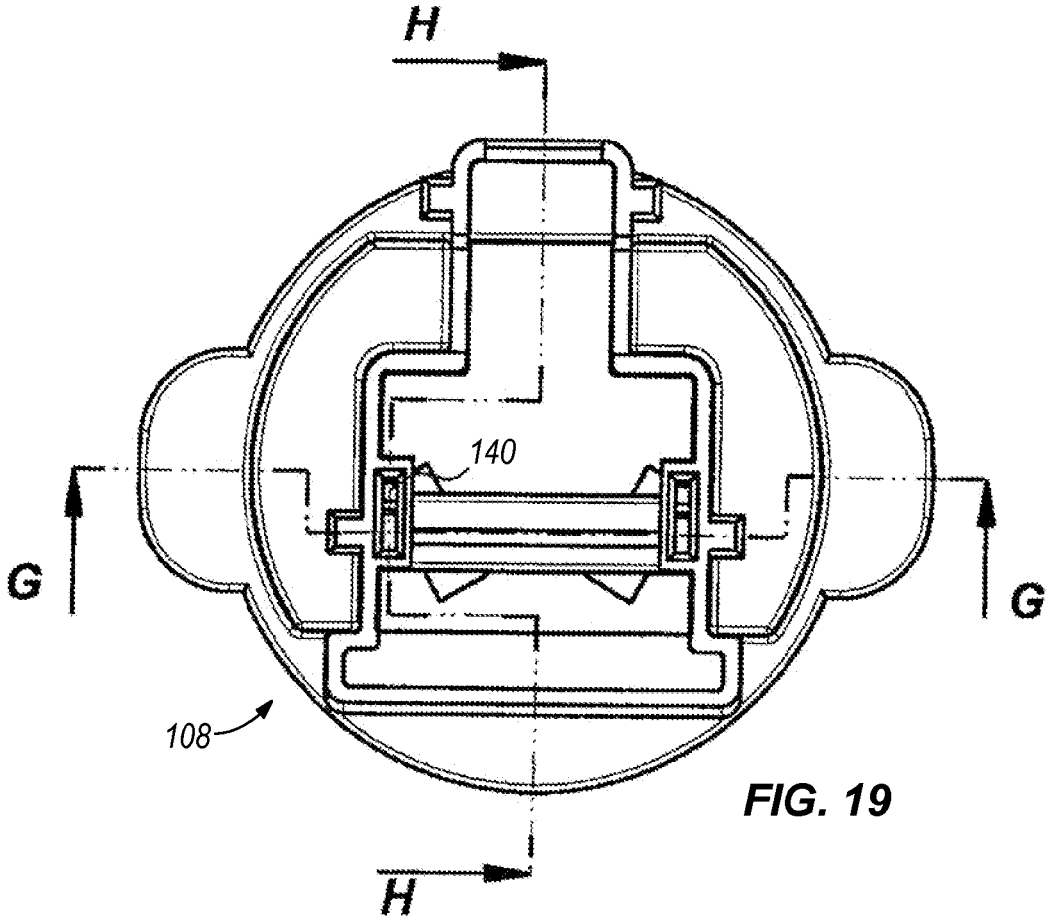
FIG. 19 shows a top view of a mains plug unit according to another advantageous embodiment.
Figure 21:
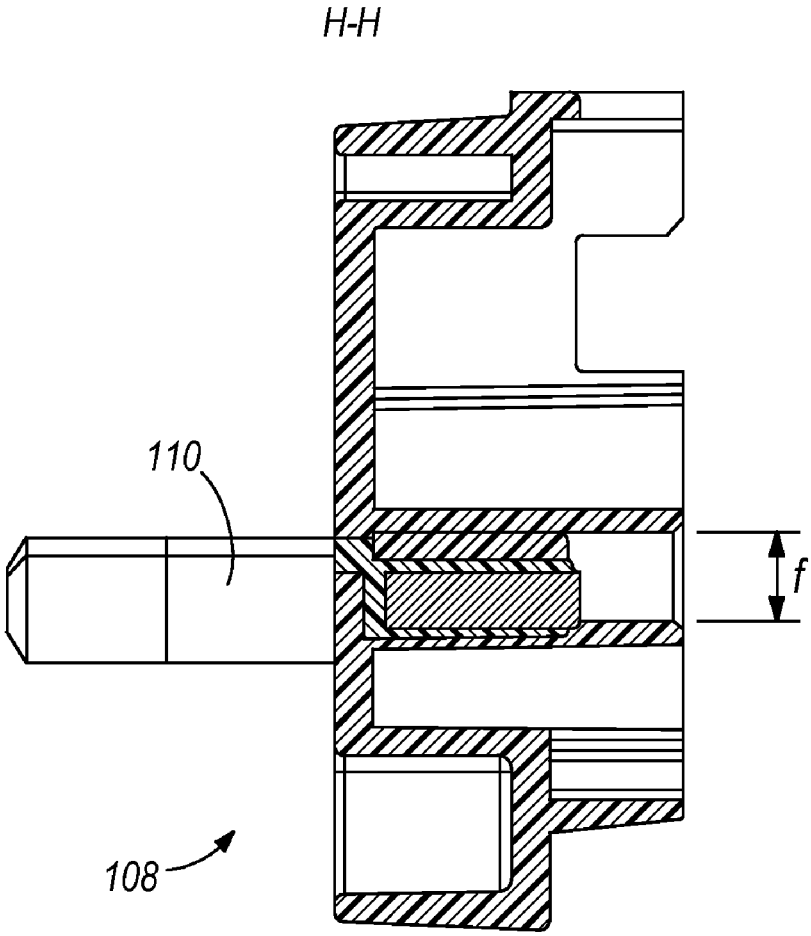
FIG. 21 shows a section through the mains plug unit according to FIG. 19 along the intersection line H-H.
Figure 24:
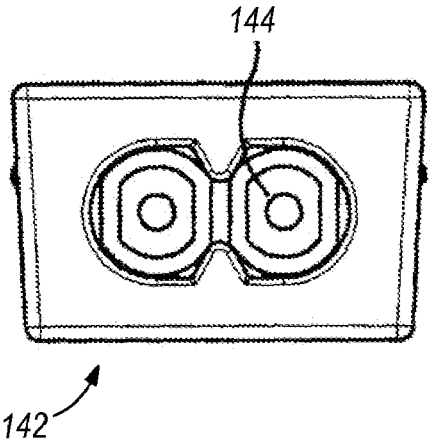
FIG. 24 shows a view of the mains cable adapter according to FIG. 22, rotated by 90°.
Figure 23:
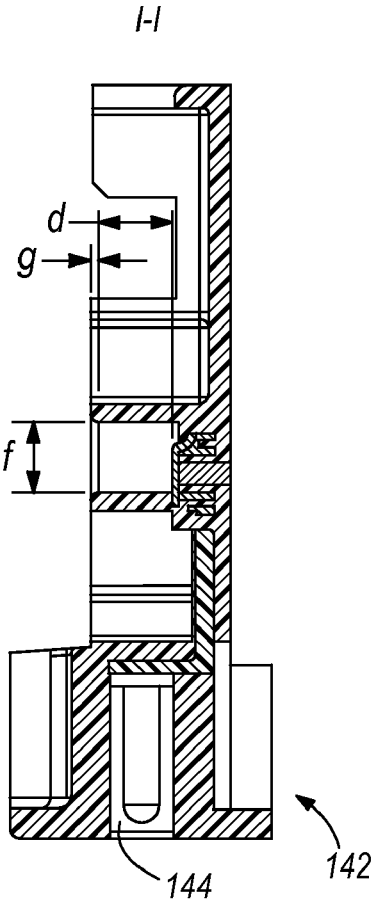
FIG. 23 shows a section through the mains cable adapter along the intersection line I-I.
Figure 22:
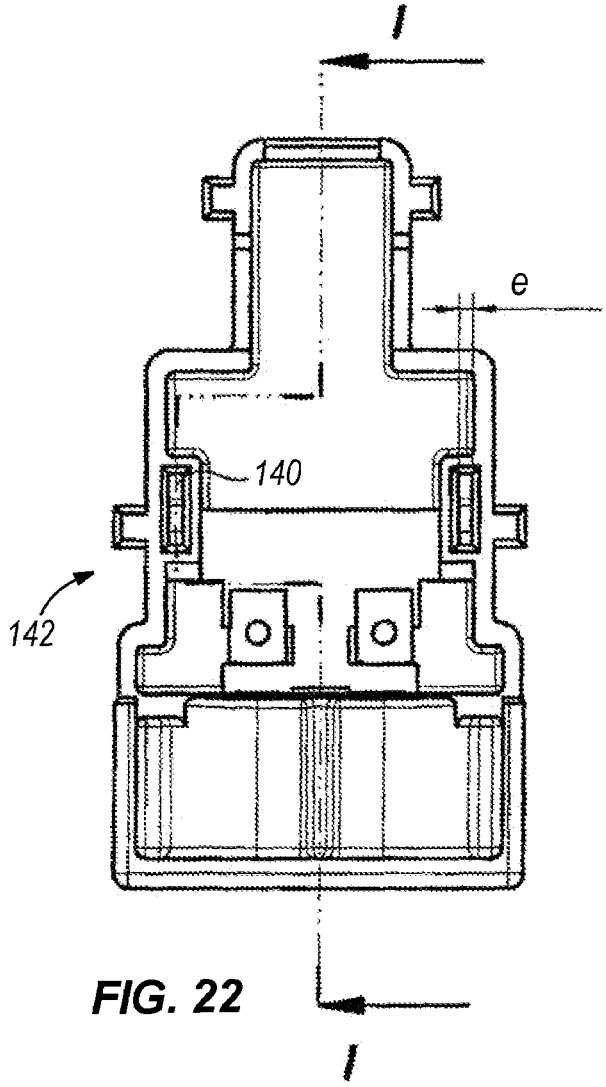
FIG. 22 shows a top view of the mains cable adapter which is adapted to be inserted into the housing according to FIG. 4.

As can be seen from FIGS. 7 and 8, the contact springs are inserted into vertical guide means on the inner surface of the sidewall of the housing (front) so that the blocking areas can be reduced, since the primary contact is arranged on the outer edge of the circuit board.

An exchangeable mains plug unit 102 according to the European standard, which can be inserted in the housing 112, is shown in FIGS. 9 to 12. As has already been mentioned, the whole mains plug unit 102 can be produced in a particularly simple manner by encompassing the mains plug pins 110 by injection moulding in a single process step.

For electrically contacting the mains plug pins 110, very small, substantially rectangular openings or recesses 140 are formed in the mains plug unit. This will guarantee that an exchangeable mains plug unit 102, which remained in the mains socket, cannot do harm to a user, even if the rest of the housing 112 should not be attached for some reason or other. In other words, the separate exchangeable mains plug unit 102 to 108 according to the present invention fulfils, as such, already all the relevant regulations on touch protection and tracking resistance, in particular the provisions of the international standard IEC 60884.

According to the present invention, the depth d of the opening 140 is at least 5 mm (plus a funnel-shaped insertion chamfering g of e.g. 0.5 mm) and the width e is less than 1 mm. The length f should be approx. 5 mm, e.g. 4.8 mm, according to the present invention.

Analogously; the additional mains plug units 104 to 108, which are shown in FIG. 13 to 21, can be mounted on the housing 112, the openings 140 having each the small dimensions according to the present invention.

Although it has always been assumed in connection with the hitherto described embodiments that the mains plug unit 102 to 108 is directly provided with mains plug pins 110 and that the plug-in power supply 100 according to the present invention is directly inserted in the mains socket, it is, in accordance with a further advantageous embodiment, also possible to provide a mains cable adapter 142 which, instead of the mains plug units 102 to 108, is connected to the housing so that the plug-in power supply 100 is connected to the socket via a mains cable which is adapted to be connected to the plug-in connector 144. The plug-in connection 144 can e.g. be implemented as a so-called shaver plug connection, which is known per se.

It follows that the present invention allows to overcome the shortcomings of the prior art and to produce an inexpensive plug-in device with a conversion plug while observing the relevant standards, making use of the smallest possible number of parts and process steps, and achieving the highest possible user comfort.

While the invention has been described with respect to the physical embodiments constructed in accordance therewith, it will be apparent to those skilled in the art that various modifications, variations and improvements of the present invention may be made in the light of the above teachings and within the purview of the appended claims without departing from the spirit and intended scope of the invention.

In addition, those areas in which it is believed that those ordinary skilled in the art are familiar have not been described herein in order to not unnecessarily obscure the invention described herein. Accordingly, it is to be understood that the invention is not to be limited by the specific illustrated embodiments, but only by the scope of the appended claims.

What is claimed is:

1. A plug-in power supply for supplying a consumer with a low voltage, the plug-in power supply comprising:

a housing including a voltage transformer module for converting a mains voltage into a low voltage, a recess, a first spring contact and a second spring contact, both contacts electrically connected to the voltage transformer module and extending through a surface of the housing within the recess, and a first wall extending substantially perpendicular to the surface of the housing within the recess and surrounding the first spring contact on at least three sides, and a second wall extending substantially perpendicular to the surface of the housing within the recess and surrounding the second spring contact on at least three sides; and an exchangeable mains plug including a housing, a first mains plug pin and a second mains plug pin, both mains plug pins extending from the housing in a first direction and configured to connect the voltage transformer module to a mains socket, a first contact pin integral with the first mains plug pin and a second contact pin integral with the second mains plug pin, both contact pins extending from the housing in a second direction opposite the first direction, the first contact pin configured to make contact with the first spring contact and the second contact pin configured to make contact with the second spring contact when the exchangeable mains plug is positioned within the recess by a first motion substantially perpendicular to the recess and a second motion substantially perpendicular to the first motion.

2. The plug-in power supply of claim 1, wherein the recess includes a rectangular cross-section with dimensions of less than 1.8 mm×4.8 mm.

3. The plug-in power supply of claim 1, wherein the first wall and the second wall are formed integrally with the housing.

4. The plug-in power supply of claim 1, wherein a respective mains plug pin is formed integrally with an associated contact pin.

5. The plug-in power supply of claim 1, wherein the mains plug pins and the contact pins are combined so as to form the mains plug unit in that they are encompassed by an insulating plastic material by means of injection moulding.

6. The plug-in power supply of claim 1, wherein the mains plug unit is adapted to be lockingly engaged with the housing.

7. The plug-in power supply of claim 6, wherein the housing comprises a pocket-like, resilient locking arm, said locking arm cooperating with a complementary locking opening on the mains plug unit so as to fix said mains plug unit.

8. The plug-in power supply of claim 1, wherein the housing has formed thereon a slotted guide means for guiding the mains plug unit during the mounting operation.

9. The plug-in power supply of claim 8, wherein the slotted guide means extends in a direction transversely to a direction in which the mains plug pins are inserted into the mains socket.

10. The plug-in power supply of claim 1, wherein the plug unit comprises a mains cable adapter with a plug-in connection and a flexible mains cable, and the mains plug pins are provided in the form of a separate mains plug.

* * * * *